US008820437B2

(12) United States Patent
Ervin et al.

(10) Patent No.: US 8,820,437 B2
(45) Date of Patent: Sep. 2, 2014

(54) CEMENTING WHIPSTOCK APPARATUS AND METHODS

(75) Inventors: David L. Ervin, Edmond, OK (US); Charles H. Dewey, Houston, TX (US); John E. Campbell, Houston, TX (US); Shantanu N. Swadi, Cypress, TX (US); Philip M. Gregurek, Pearland, TX (US)

(73) Assignee: Smith International, Inc., Houston, TX (US)

( * ) Notice: Subject to any disclaimer, the term of this patent is extended or adjusted under 35 U.S.C. 154(b) by 498 days.

(21) Appl. No.: 13/085,586

(22) Filed: Apr. 13, 2011

(65) Prior Publication Data

US 2011/0253387 A1 Oct. 20, 2011

Related U.S. Application Data

(60) Provisional application No. 61/325,068, filed on Apr. 16, 2010.

(51) Int. Cl.
*E21B 7/06* (2006.01)
*E21B 7/08* (2006.01)
*E21B 33/14* (2006.01)

(52) U.S. Cl.
USPC ..... 175/61; 166/50; 166/117.6; 166/285; 166/313

(58) Field of Classification Search
CPC ..... E21B 7/016; E21B 29/06; E21B 33/14
USPC ..... 166/313, 285, 382, 387, 50, 117.6, 166/177.4; 175/61
See application file for complete search history.

(56) References Cited

U.S. PATENT DOCUMENTS

| | | | | | |
|---|---|---|---|---|---|
| 2,509,144 | A | * | 5/1950 | Grable et al. | 175/81 |
| 4,765,404 | A | * | 8/1988 | Bailey et al. | 166/117.6 |
| 5,154,231 | A | * | 10/1992 | Bailey et al. | 166/298 |
| 5,318,132 | A | * | 6/1994 | Odorisio | 166/382 |
| 5,437,340 | A | * | 8/1995 | Lee et al. | 175/61 |
| 5,443,129 | A | | 8/1995 | Bailey et al. | |
| 5,762,143 | A | * | 6/1998 | Comeau et al. | 166/381 |
| 5,806,596 | A | | 9/1998 | Hardy et al. | |
| 6,053,250 | A | | 4/2000 | Echols | |
| 6,167,970 | B1 | | 1/2001 | Stout et al. | |
| 6,334,487 | B1 | * | 1/2002 | Adkins et al. | 166/55.7 |
| 7,077,212 | B2 | * | 7/2006 | Roesner et al. | 166/382 |
| 7,086,481 | B2 | * | 8/2006 | Hosie et al. | 166/387 |
| 7,650,946 | B2 | | 1/2010 | Gazewood | |

(Continued)

OTHER PUBLICATIONS

International Preliminary Report on Patentability with Written Opinion of the International Searching Authority for International Application No. PCT/US2011/032224, Daejeon, South Korea, Oct. 16, 2012.

(Continued)

*Primary Examiner* — Jennifer H Gay

(57) ABSTRACT

A technique facilitates sidetracking by eliminating one or more trips downhole. The technique comprises delivering a sidetracking system downhole into a wellbore, and utilizing a component of the sidetracking system to grip a wall of the wellbore. The sidetracking system may comprise a whipstock assembly and a running/stinger assembly in which the stinger assembly is designed for disconnection from the whipstock assembly after delivery downhole. After disconnecting the stinger assembly, the sidetracking system enables delivery of cement slurry down through the stinger assembly to form a cement plug at a desired location.

44 Claims, 5 Drawing Sheets

(56) References Cited

U.S. PATENT DOCUMENTS

| | | | | |
|---|---|---|---|---|
| 2003/0070815 | A1 | 4/2003 | Sullaway et al. | |
| 2004/0055755 | A1* | 3/2004 | Roesner et al. | 166/382 |
| 2011/0253387 | A1* | 10/2011 | Ervin | 166/382 |
| 2011/0315371 | A1* | 12/2011 | Khodayar et al. | 166/117.6 |
| 2012/0000673 | A1 | 1/2012 | Hogan et al. | |
| 2013/0213654 | A1 | 8/2013 | Dewey et al. | |

OTHER PUBLICATIONS

International Search Report for International Application No. PCT/US2011/032224, Daejeon, South Korea, Oct. 25, 2011.

Written Opinion of the International Searching Authority for International Patent Application No. PCT/US2011/032224, Daejeon, South Korea, Oct. 25, 2011.

International Search Report for International Application No. PCT/US2013/027114, Daejeon Metropolitan City, South Korea, Jun. 21, 2013.

Written Opinion of the International Searching Authority for International Application No. PCT/US2013/027114, Daejeon Metropolitan City, South Korea, Jun. 21, 2013.

* cited by examiner

CEMENTING WHIPSTOCK APPARATUS AND METHODS

CROSS-REFERENCE TO RELATED APPLICATION

The present document is based on and claims priority to U.S. Provisional Application Ser. No. 61/325,068, filed Apr. 16, 2010.

BACKGROUND

Embodiments disclosed herein relate generally to whipstocks for sidetracking from a wellbore. In particular, embodiments disclosed herein relate to whipstock systems and methods.

Traditionally, whipstocks have been used to drill deviated boreholes from an existing wellbore. A whipstock has a ramped surface that is set in a predetermined position to guide a drill bit or drill string in a deviated manner to drill into the side of the wellbore, which may also be called a sidetrack window or window. In operation, the whipstock is set on the bottom of the existing wellbore, the set position of the whipstock is then surveyed, and the whipstock is properly oriented for directing the drill string in the proper direction. After the whipstock is set, a drill string is lowered into the well into engagement with the whipstock causing the drill string to drill a deviated borehole through a wall of the existing wellbore.

Other uses for whipstocks include sidetracking from previously drilled and cased wellbores that have become unproductive. For example, when a wellbore becomes unusable, a new borehole may be drilled in the vicinity of the existing cased wellbore or, alternatively, a new borehole may be sidetracked from the serviceable portion of the existing, cased wellbore. Sidetracking from a cased wellbore also may be useful for developing multiple production zones. This procedure can be accomplished by milling through the side of the casing with a mill that is guided by a wedge or whipstock component. After a milling or drilling procedure is completed, the whipstock may be removed from the wellbore.

Cement plugs may be set in the wellbore in sidetracking operations to prevent hydrocarbons or other fluids from lower sections of the wellbore seeping up past the whipstock location. The cement plug is set below the whipstock to isolate lower sections of the wellbore. Typically, a cement plug may be set during a first trip into the wellbore, after which the whipstock may be run into the wellbore in a second trip. Accordingly, existing operations employ two or more trips downhole.

SUMMARY

In general, the present invention provides a system and method to facilitate sidetracking by eliminating one or more trips downhole. The technique comprises delivering a sidetracking system downhole into a wellbore, and utilizing a component of the sidetracking system to grip a wall of the wellbore. The sidetracking system may comprise a whipstock assembly and a stinger assembly in which the stinger assembly is designed for disconnection from the whipstock assembly after delivery downhole. After disconnecting the stinger assembly, the sidetracking system enables delivery of cement slurry down through the stinger assembly to form a cement plug at a desired location in the same trip downhole.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and methodology designed to facilitate sidetracking operations in which one or more lateral wellbores are formed with respect to another wellbore, e.g. with respect to a vertical wellbore. According to one aspect, certain embodiments disclosed herein relate to a sidetracking system including a whipstock assembly having a central bore therethrough and an expandable anchor assembly configured to be hydraulically actuated and set at a specific depth in a wellbore. The sidetracking system also may comprise a removable flow blocking member, e.g. a burst disc, to restrict a fluid flow and to increase a pressure in the central bore to actuate the expandable anchor, e.g. expandable slips and/or packer. The sidetracking system enables setting of the whipstock and creation of a cement plug in a single trip downhole into the wellbore.

Figure 1:
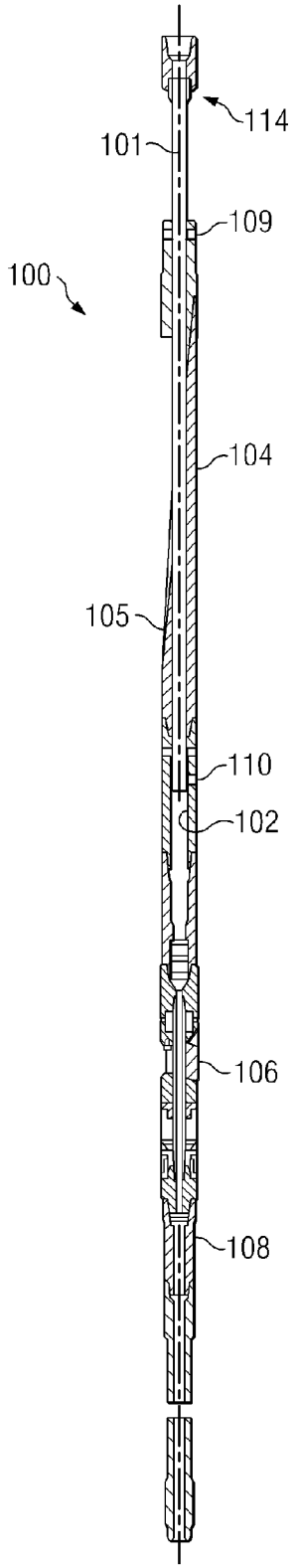
FIG. 1 is a cross-sectional view of a sidetracking system in accordance with embodiments of the present disclosure.
Figure 2:
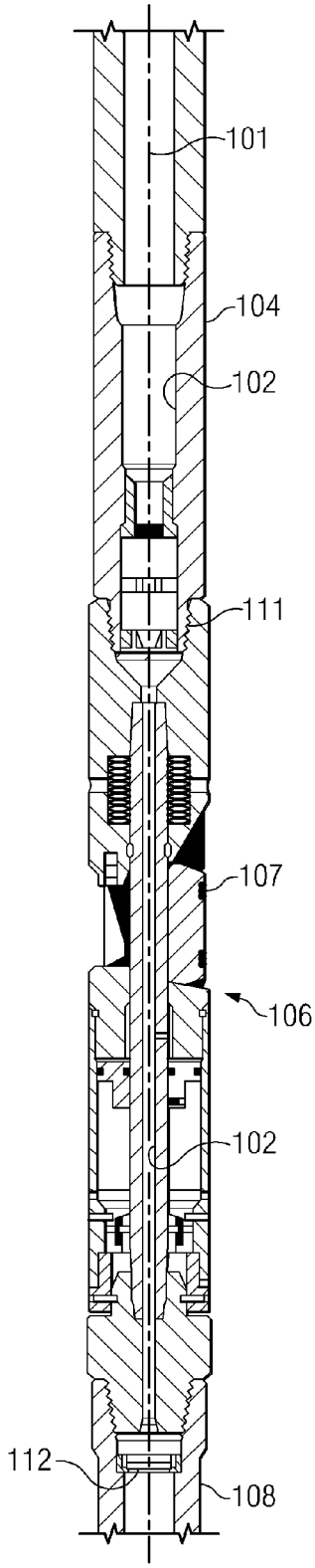
FIG. 2 is an enlarged cross-sectional view of a portion of the sidetracking system illustrated in FIG. 1.

Referring generally to FIGS. 1 and 2, cross-sectional views are provided of a sidetracking system 100 having a central bore 102 therethrough in accordance with embodiments of the present disclosure. In the embodiment illustrated, the sidetracking system 100 comprises a whipstock assembly 104 having an expandable anchor assembly 106 attached below the whipstock assembly. The whipstock assembly 104 comprises a sidetracking slide or ramp 105 formed to facilitate drilling of a sidetracked window and lateral wellbore. The whipstock assembly 104 may be oriented about a central axis 101 in any direction (i.e. 360°) so that a sidetracked wellbore may be drilled in a desired direction.

The expandable anchor assembly 106 may be attached to the whipstock assembly 104 via a threaded connection 111. Alternatively, other types of connections also may be used.

The expandable anchor assembly 106 comprises multiple slips 107 that may be expanded radially outward to engage a surrounding wellbore wall, such as a formation wall or casing. Engagement of the slips 107 with the surrounding wellbore wall anchors the sidetracking assembly 100 at the desired location in the wellbore. The slips 107 may be hydraulically actuated by increasing the pressure on fluid within the central bore 102 to cause the slips 107 to expand radially outward. However, the slips 107 may be actuated by other techniques, e.g. mechanical actuation.

A sub 108 of the sidetracking system 100 may be constructed as a burst sub having a removable member, e.g. a burst disc 112. By way of example, the sub 108 may be attached to a lower end of the expandable anchor assembly 106. The burst disc 112 enables the increasing of pressure in the central bore 102 to actuate the expandable anchor assembly 106. In this example, the sub 108 contains any type of burst disc 112 or other type of pressure control device having a membrane or restriction configured to fail at a predetermined pressure. As an alternative, the sub 108 can contain a piston-type shear release mechanism or other suitable mechanism to release the pressure at a predetermined level.

Integration of the expandable anchor assembly 106 and the burst sub 108 with the whipstock assembly 104 enables the sidetracking system 100 to be located at any depth in a wellbore because the expandable anchor assembly 106 may be set at any desired location or wellbore depth. Thus, the sidetracking system 100 is capable being disposed in a wellbore at locations other than a bottom of the wellbore and other than the top of a stationary object, e.g. a "fish", in the wellbore.

Referring again to FIGS. 1 and 2, methods of using the sidetracking system 100 in accordance with embodiments disclosed herein include running the sidetracking system 100 into the wellbore to a specified location or depth of the wellbore. As the sidetracking system 100 is run into the wellbore, fluid is circulated above the whipstock assembly 104 through a pass valve (circulating valve) (not shown) for measurement-while-drilling ("MWD") purposes, e.g. to find a particular desired wellbore direction for sidetracking. Physical properties of the sidetracking system, such as bore pressure, temperature, and wellbore trajectory may be measured while running the sidetracking system 100 into the wellbore. Those skilled in the art will be familiar with MWD operations and methods of using the collected data to orient the sidetracking apparatus in the wellbore. Based on the MWD data taken from the wellbore, the whipstock assembly 104 may be oriented in a wellbore so the sidetracking ramp 105 faces a direction in which the sidetracked wellbore will extend. In alternate embodiments, a gyro orienting system may be employed to orient the whipstock assembly 104 in the wellbore, e.g. in a vertical wellbore.

Subsequently, an operator may increase pressure in the central bore 102 of the sidetracking system 100 by pumping a fluid into the central bore 102 and/or by cycling pumps to close the bypass valve. In certain embodiments, the fluid may be a drilling fluid. In alternate embodiments, the fluid used maybe a separate actuation fluid from a separate fluid source. If a separate actuating fluid is used, the separate actuating fluid is isolated by, for example, a running tool and a running tool piston (not shown). The fluid flows down the central bore to the burst disc 112 (or other blocking member), which prevents the fluid from flowing further and thus allows a pressure increase in the central bore 102. The pressure increase is used to hydraulically actuate the multiple slips 107 of the expandable anchor assembly 106. For example, the pressure causes slips 107 to radially expand and engage the surrounding wellbore wall. Depending on the type of anchor assembly 106, various hydraulic pressure increases may be applied in the central bore 102 to force the slips 107 into proper engagement with the surrounding wellbore wall and thus to set the expandable anchor assembly 106 at the desired wellbore location.

After slips 107 are radially expanded and engaged with the surrounding wellbore wall, e.g. formation or casing, and the sidetracking system 100 is properly set in the wellbore, the burst disc 112 in burst sub 108 may be ruptured through application of additional pressure. This allows the cementing operation to commence to form a cement plug in the wellbore below the sidetracking system 100. In some applications, the burst disc 112 may be ruptured by exerting an axial force downward on the whipstock assembly 104 in a manner which causes shear pins 109 and 110 to fail. By way of example, shear pin 109 may be designed to fail first followed by failure of shear pin 110. As described in greater detail below, the shearing of shear pins 109, 110 (or other suitable release member) may be used to release a running assembly, e.g. stinger assembly, 114 prior to pumping cement down through central bore 102. This ensures easy retrieval of the running assembly 114 following the cementing operation. The cementing operation is designed to form and set a cement plug in the wellbore below or adjacent the sidetracking system 100 to isolate a lower section of the wellbore from the sidetracking region at which the lateral wellbore is formed. Following cementing, a drill string having a drill bit is conveyed downhole into engagement with a whipstock of the whipstock assembly 104. Once the drill string is downhole, the drilling operation may be commenced to form a sidetracked well with the aid of the whipstock assembly 104.

Embodiments of the present disclosure provide a sidetracking system that can simultaneously set a whipstock assembly and a cement plug in a single trip into the wellbore. The sidetracking system may be used at any location or depth of the wellbore, as opposed to conventional sidetracking devices that must be located either at a bottom of the wellbore or on top of a stationary object. By decreasing the number of trips into the wellbore, the time and costs associated with drilling deviated wellbores is decreased.

Figure 3:
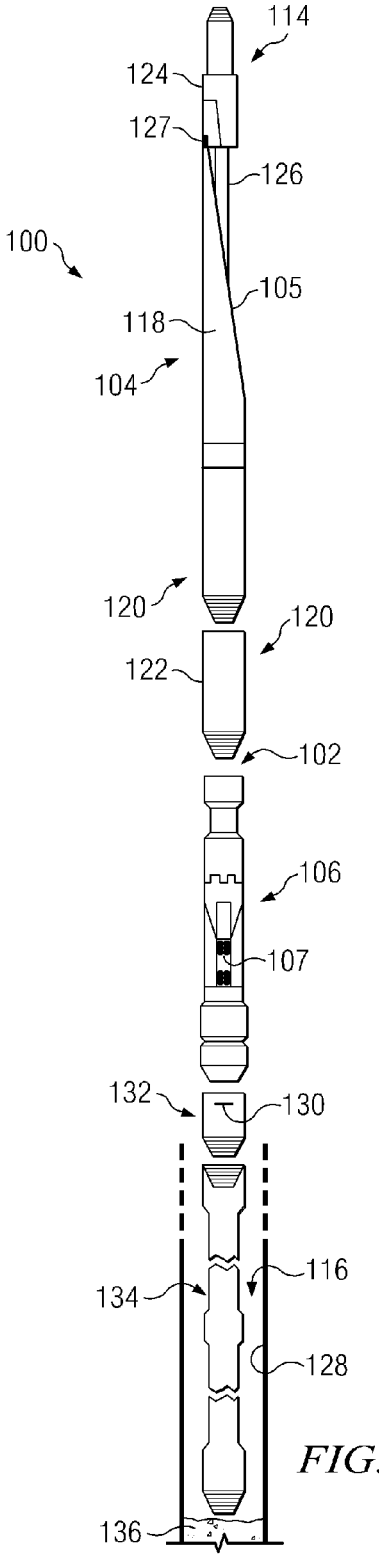
FIG. 3 is a schematic illustration of another example of a sidetracking system in accordance with embodiments of the present disclosure.

Referring generally to FIG. 3, another embodiment of the sidetracking system 100 is illustrated. In this embodiment, the sidetracking system 100 is illustrated as disposed in a wellbore 116. The sidetracking system 100 comprises whipstock assembly 104 having a whipstock 118 comprising the sidetracking slide or ramp 105. The whipstock assembly 104 also may comprise a variety of other components 120, such as an anchor spacer 122. The whipstock assembly 104 and the entire sidetracking system 100 may be conveyed downhole into the wellbore 116 via stinger assembly 114. In this embodiment, stinger assembly 114 comprises a setting tool 124 coupled to whipstock 118. The stinger assembly 114 also comprises a stinger 126 which extends down into whipstock assembly 104 to deliver a cement slurry along the central bore 102 for forming the cement plug at a desired location along wellbore 116. The stinger assembly 114 is secured to whipstock assembly 104 or to another suitable component by a release mechanism 127, such as the shear pins 109 and/or 110 described with reference to FIG. 1. However, other types of release mechanisms 127, e.g. latches, may be employed.

In this embodiment, the sidetracking system 100 further comprises expandable anchor 106 which may be coupled to anchor spacer 122 beneath whipstock assembly 104. The expandable anchor assembly 106 comprises expandable slips 107 which may be selectively expanded against a surrounding wall 128 of wellbore 116 to secure the sidetracking system 100 at a desired location along the wellbore 116. By way of example, the expandable slips 107 may be expanded hydraulically by pressurizing fluid within central bore 102 against a flow restriction member 130 which may be positioned in a burst sub 132. The flow restriction member 130 may comprise burst disc 112 or other suitable flow restriction members, such as a ball dropped onto a ball seat in the burst sub 132, as discussed in greater detail below. The burst sub 132 may be located below expandable anchor 106.

As illustrated, a tail pipe 134 may be positioned below expandable anchor 106 to direct cement slurry to the desired wellbore location for forming of a cement plug 136. By way of example, the tail pipe 134 is coupled to a lower end of the burst sub 132, although other components may be incorporated into this design. The length of tail pipe 134 may be selected according to the desired placement of cement plug 136. It should be noted, however, that sidetracking system 100 may have a variety of configurations and utilize a variety of components to place the cement plug 136 at other desired locations along wellbore 116. For example, sidetracking system 100 may be utilized to place the cement plug 136 at a bottom of the wellbore or at any of a variety of locations along wellbore 116 separate from the bottom of the wellbore.

In operation, the sidetracking system 100 illustrated in FIG. 3 is initially run in hole to a desired setting depth. The whipstock 118 is then oriented with a measurement-while-drilling system or a gyro system, as discussed above. Once oriented, pressure is increased along the central bore 102 to set the expandable anchor 106 which secures the sidetracking system 100 at the desired location along wellbore 116. After setting the expandable anchor 106, the pressure in central bore 102 is increased to fracture or otherwise remove the flow restriction member 130, thus allowing flow of cement slurry down through the sidetracking system.

The stinger assembly 114 is then disconnected from the whipstock assembly 104 by releasing the setting tool 124 from the whipstock 118. The release of setting tool 124 may be achieved by separating, e.g. shearing, release mechanism 127 which may be in the form of a suitable shear member, e.g. shear pins 109, 110. However, other types of release mechanisms 127 may be employed to enable selective separation of stinger assembly 114 from the portion of sidetracking system 100 which remains downhole. Following separation of the stinger assembly 114, cement is pumped down through stinger 126 and through the sidetracking system 100 to establish cement plug 136 at the desired location within wellbore 116. After the cement is pumped, the stinger assembly 114, including setting tool 124 and stinger 126, is tripped out of the hole and removed. At this stage, a drilling assembly may be conveyed downhole into engagement with whipstock 118 of whipstock assembly 104. The ramp 105 is designed to support the drilling assembly and to direct the assembly laterally to facilitate sidetracking and formation of the desired lateral wellbore. By way of example, the ramp 105 of whipstock 118 may be concave and formed from a hard material, such as steel. The ramp 105 also may be angled at a desired angle, e.g. up to 3°, designed to achieve the planned sidetracking transition in forming the lateral wellbore.

Figure 4:
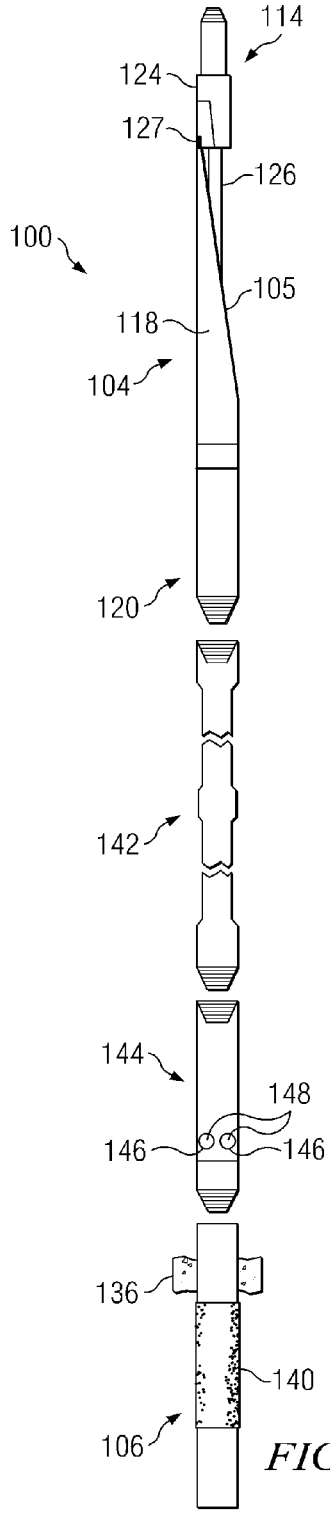
FIG. 4 is a schematic illustration of another example of a sidetracking system in accordance with embodiments of the present disclosure.

Referring generally to FIG. 4, another embodiment of the sidetracking system 100 is illustrated. In this embodiment, the sidetracking system 100 may again be disposed in wellbore 116. The sidetracking system 100 similarly comprises whipstock assembly 104 having whipstock 118 and sidetracking ramp 105. The whipstock assembly 104 and the entire sidetracking system 100 may be conveyed downhole into the wellbore 116 via stinger assembly 114. In this embodiment, stinger assembly 114 again comprises setting tool 124, coupled to whipstock 118, and stinger 126. Stinger 126 extends down into whipstock assembly 104 to deliver a cement slurry along the central bore 102 for forming the cement plug at a desired location along wellbore 116. The stinger assembly 114 is secured to whipstock assembly 104 or to another suitable component by the release mechanism 127, e.g. a shear mechanism which may be in the form of shear pins 109 and/or 110.

In this embodiment, however, the expandable anchor 106 is in the form of a packer 140, such as an inflatable packer, positioned below whipstock assembly 104. The packer 140 is designed to seal against the surrounding wellbore wall 128 to provide a platform on which cement plug 136 may be formed at a desired location above the bottom of wellbore 116. In the specific example illustrated, the whipstock assembly 104 and packer 140 are separated by additional components, such as an intermediate tail pipe 142 and a circulation sub 144. The tail pipe 142 may be selected to facilitate positioning of the cement plug at a desired location along the wellbore 116. The circulation sub 144 comprises one or more ports 146 through which cement slurry is expelled to create the cement plug. The ports 146 may initially be blocked by suitable blocking members 148, such as burst discs. It should be noted that expansion of packer 140 may be achieved according to a variety of methods depending on the specific type of packer selected. For example, the packer 140 may be a swell packer, a mechanically actuated packer, an inflatable packer, or other suitable seal members designed to form a seal between the sidetracking system 100 and the surrounding wellbore wall 128. If pressurized fluid is needed to inflate packer 140, a burst sub 132 may be positioned below the packer or a ball and ball seat may be incorporated into the inflatable packer.

The embodiment illustrated in FIG. 4 provides reliable spotting of the cement plug location even when the cement plug is located significantly off-bottom. Furthermore, the packer 140 is able to provide additional isolation even if the cement plug 136 has integrity issues, e.g. honeycombing. This type of design also enables use of a shorter cement plug which, in turn, requires less tail pipe and less cement to create greater efficiencies with respect to the sidetracking operation.

In operation, the sidetracking system 100 illustrated in FIG. 4 is initially run in hole to a desired setting depth. The whipstock 118 is then oriented with a measurement-while-drilling system or a gyro system. Once oriented, the packer 140 is expanded against the surrounding wellbore wall. By way of example, a ball may be dropped to block flow along central bore 102 which allows the pressure to be increased to set an inflatable packer. Pressure is then increased further to open flow through ports 146 by, for example, fracturing blocking members 148, e.g. rupture discs.

The stinger assembly 114 is then disconnected from the whipstock assembly 104 by releasing the setting tool 124 from the whipstock 118. The release of setting tool 124 may be achieved by, for example, shearing the release member 127 which may be in the form of shear pins 109, 110. However, other types of release mechanisms 127 may be employed to enable selective separation of stinger assembly 114 from the portion of sidetracking system 100 which remains downhole. Following separation of the stinger assembly 114, cement is pumped down through stinger 126 and through the sidetracking system 100 until flowing outwardly through ports 146 to a location above packer 140. This enables the cement plug 136 to be established at a location above the packer. After the cement is pumped, the stinger assembly 114, including setting tool 124 and stinger 126, is tripped out of the hole and removed. At this stage, a drilling assembly may be conveyed downhole to begin the sidetracking stage of operation in which the lateral wellbore is drilled.

Figure 5:
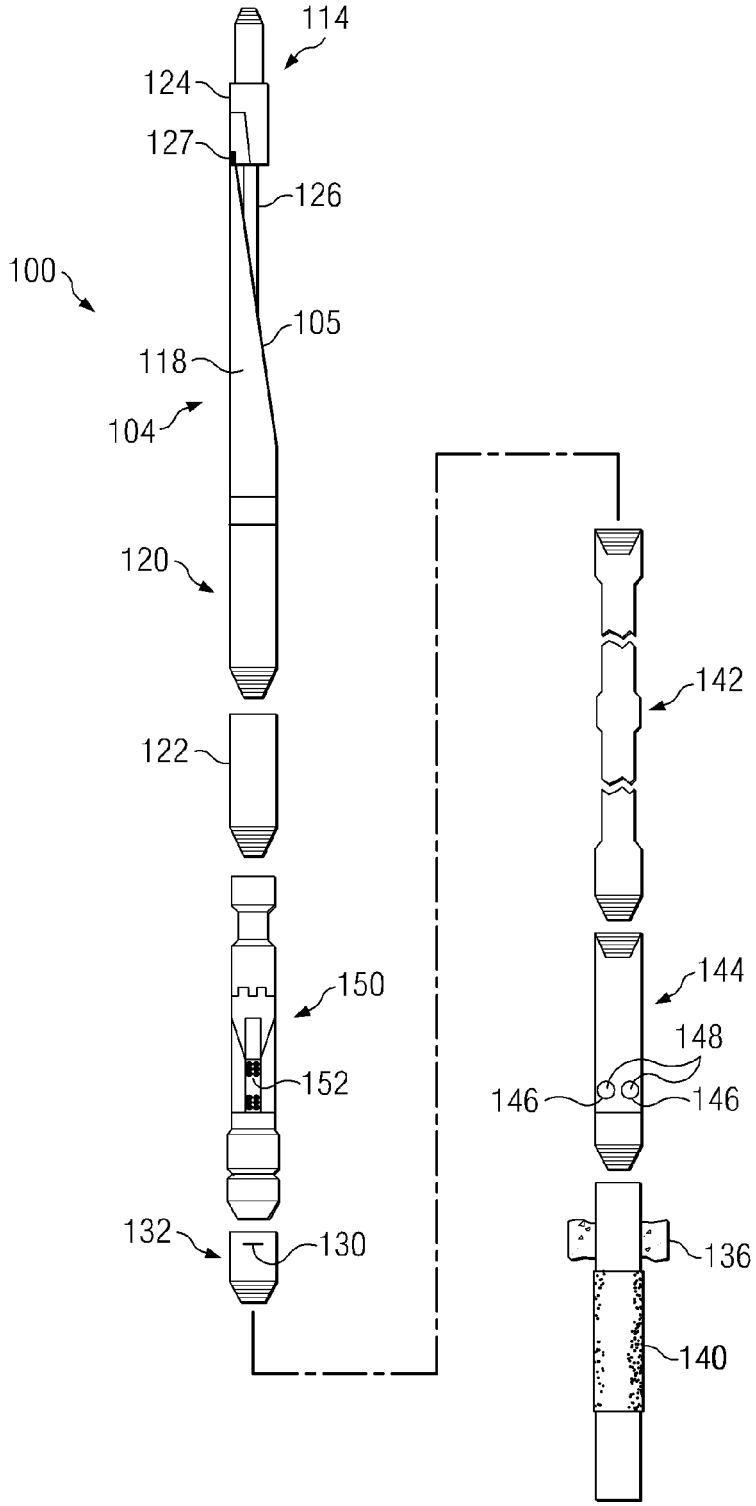
FIG. 5 is a schematic illustration of another example of a sidetracking system in accordance with embodiments of the present disclosure.

Referring generally to FIG. 5, another embodiment of the sidetracking system 100 is illustrated. In this embodiment, the sidetracking system 100 may again be disposed in wellbore 116. The sidetracking system 100 similarly comprises whipstock assembly 104 having whipstock 118 and sidetracking ramp 105. The whipstock assembly 104 and the entire sidetracking system 100 may be conveyed downhole into the wellbore 116 via stinger assembly 114 which comprises setting tool 124 and stinger 126. The stinger 126 again extends down into whipstock assembly 104 to deliver a cement slurry along the central bore 102 to form the cement plug at a desired location along wellbore 116. The stinger assembly 114 may again be secured to whipstock assembly 104 or to another suitable component by the release mechanism 127, e.g. a shear mechanism which may be in the form of shear pins 109 and/or 110.

In this embodiment, however, the expandable packer 140, e.g. an inflatable packer, is combined with another expandable anchor 150. The expandable anchor 150 may be constructed in a variety of configurations, but one suitable embodiment utilizes a plurality of slips 152 which may be expanded against the surrounding wellbore wall 128. Expandable anchor 150 may be similar to that described above with respect to the expandable anchor assembly 106 utilized in the embodiments of FIGS. 1-3. The packer 140 is designed to seal against the surrounding wellbore wall 128 to provide a platform on which cement plug 136 may be formed at a desired location above the bottom of wellbore 116. However, the additional expandable anchor 150 helps support the sidetracking system 100 at the desired location within wellbore 116.

In the specific example illustrated, the expandable anchor 150 is located below whipstock assembly 104 and separated from the whipstock assembly 104 by anchor spacer 122. The burst sub 132 with flow restriction member 130 may be positioned beneath the expandable anchor 150 and above inflatable packer 140. The expandable anchor 150 and packer 140 also may be separated by additional components, such as the intermediate tail pipe 142 and the circulation sub 144. The tail pipe 142 may be selected to facilitate positioning of the cement plug at a desired location along a wellbore. As described above, the circulation sub 144 may comprise one or more ports 146 through which cement slurry is expelled to create the cement plug. The ports 146 may initially be blocked by suitable blocking members 148, such as burst discs. It should again be noted that expansion of packer 140 may be achieved according to a variety of methods depending on the specific type of packer selected. For example, the packer 140 may be a swell packer, a mechanically actuated packer, an inflatable packer, or other suitable seal member designed to form a seal between the sidetracking system 100 and the surrounding wellbore wall 128. If pressurized fluid is needed to inflate packer 140, a burst sub 132 may be positioned below the packer or a ball and ball seat may be incorporated into the inflatable packer.

The embodiment illustrated in FIG. 5 utilizes expandable anchor 150 to provide primary support, while the packer 140 can serve as a secondary supporting member. Furthermore, the packer 140 is able to provide additional isolation even if the cement plug 136 has integrity issues, e.g. honeycombing. This type of design also provides for reliable space out of the cement plug 136 especially when setting the plug off the bottom of the well. This design also enables use of a shorter cement plug which, in turn, requires less tail pipe and less cement to create greater efficiencies with respect to the sidetracking operation.

In operation, the sidetracking system 100 illustrated in FIG. 5 is initially run in hole to a desired setting depth. The whipstock 118 is then oriented with a measurement-while-drilling system or a gyro system. Once oriented, pressure is increased in central bore 102 to set the expandable anchor 150. After setting expandable anchor 150, the pressure is further increased to open flow through burst sub 132 by removing, e.g. fracturing, the flow restriction member 130. The packer 140 is then expanded against the surrounding wellbore wall by, for example, dropping a ball to block flow along central bore 102 which allows the pressure to be increased to set an inflatable packer. However, packer 140 may have a variety of other configurations and may be set according to other techniques. Pressure is then increased further to open flow through ports 146 by removing port blocking members 148, e.g. fracturing rupture discs.

The stinger assembly 114 is then disconnected from the whipstock assembly 104 by releasing the setting tool 124 from the whipstock 118. The release of setting tool 124 may be achieved by, for example, shearing the release member 127 which may be in the form of shear pins 109, 110. However, other types of release mechanisms 127 may be employed to enable selective separation of stinger assembly 114 from the portion of sidetracking system 100 which remains downhole. Following separation of the stinger assembly 114, cement is pumped down through stinger 126 and through the sidetracking system 100 until flowing outwardly through ports 146 to a location above packer 140. After the cement is pumped, the stinger assembly 114, including setting tool 124 and stinger 126, is tripped out of the hole and removed. At this stage, a drilling assembly may be conveyed downhole to begin the sidetracking stage of operation in which the lateral wellbore is drilled. It should be noted that in each of these embodiments, the stinger assembly 114 is separated from the whipstock assembly 104 prior to pumping cement to create the cement plug 136. In many applications, this technique can be extremely helpful in avoiding retrieval problems with respect to the setting tool 124 and stinger 126.

The design, configuration, and arrangement of components within each embodiment of the sidetracking system 100 can vary to suit the parameters or requirements of a given sidetracking operation. For example, a variety of burst subs 132 may be utilized for controlling flow of drilling fluid through the sidetracking system 100 and for controlling actuation of expandable anchors or other devices.

Figure 6:
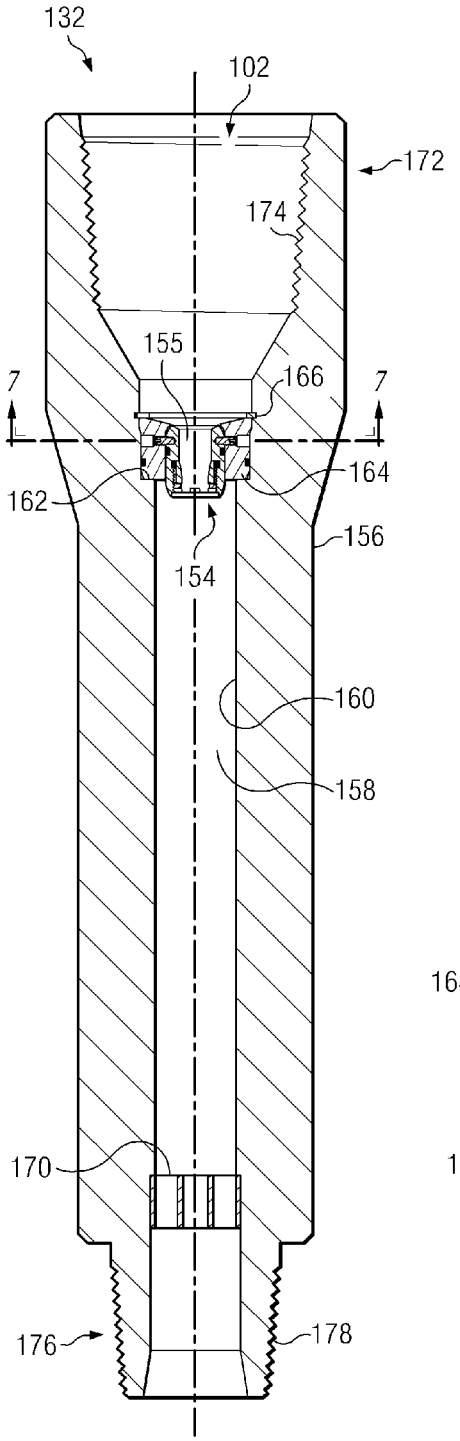
FIG. 6 is a cross-sectional view of a burst sub assembly which may be employed in a sidetracking system in accordance with embodiments of the present disclosure.
Figure 7:
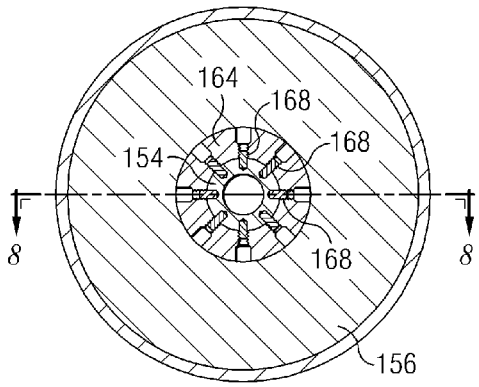
FIG. 7 is a cross-sectional view taken generally along line 7-7 of FIG. 6.
Figure 8:
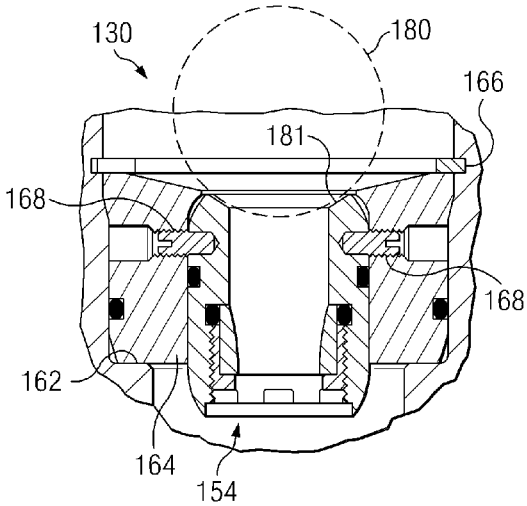
FIG. 8 is a cross-sectional view taken generally along line 8-8 of FIG. 7.

Referring generally to FIGS. 6-8, an alternate embodiment of burst sub 132 is illustrated. As described above, the burst sub 132 may incorporate a rupture or burst disc, such as burst disc 112. However, the embodiment illustrated in FIGS. 6-8 provides an alternate burst sub 132 which utilizes a ball drop shear barrel assembly 154 having an internal flow through passage 155. The burst sub 132 comprises a sub housing 156 having an internal flow path 158 which is part of the central bore 102 through which cement slurry may be passed.

The internal flow path 158 is defined by an internal surface 160 which is designed with a shoulder 162. The shoulder 162 receives a manifold 164 which carries the ball drop shear barrel assembly 154. The manifold 164 is secured against shoulder 162 by a retention ring 166, and the ball drop shear barrel assembly 154 is removably secured within manifold 164. In the example illustrated, the ball drop shear barrel assembly 154 is temporarily secured to manifold 164 by a plurality of shear members 168, as illustrated best in FIGS. 7 and 8. The shear members 168 may comprise shear screws threaded into ball drop shear barrel assembly 154.

In the embodiment illustrated, burst sub 132 further comprises a debris screen 170 positioned in internal flow path 158.

The debris screen 170 may be sized to separate debris of a specific size. Additionally, the burst sub 132 may have a variety of connection ends designed for engagement with other components of the sidetracking system 100. For example, an upper end of the sub 132 may be in the form of a box end 172 having an internal, threaded connector 174 designed for engagement with the lower end of expandable anchor 106, with expandable anchor 150, or with other system components. On an opposite end, the burst sub 132 may comprise a pin end 176 having an externally threaded connector 178 similarly designed for connection with adjacent components in a variety of embodiments of the sidetracking system 100.

In operation, the internal flow passage 155 of ball drop shear barrel assembly 154 may be left open during tripping of the sidetracking system 100 downhole to allow free flow of well fluid therethrough. Once the system 100 is at the desired position and ready for increased pressure, a ball 180 is dropped onto an upper ball seat 181 of the ball drop shear assembly 154 to create flow restriction member 130 (see FIG. 8), thereby enabling increased pressure along central bore 102 to actuate, for example, the expandable anchor. Subsequently, the pressure may be further increased to shear off shear members 168 so that ball 180 and ball drop shear barrel assembly 154 release and flow down through the sidetracking system to clear a path for the cement slurry used to form cement plug 136. In other embodiments, the ball drop shear barrel assembly 154 may incorporate a burst disc or other shear mechanism which fractures at a lower pressure than the shear members 168 to enable application of two different pressure levels.

Figure 9:
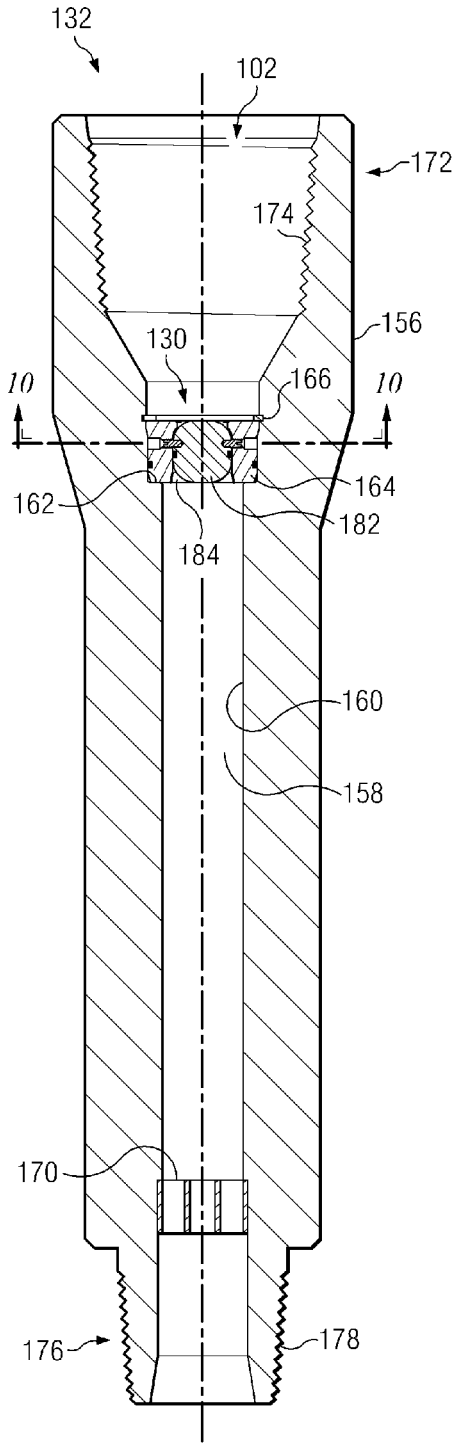
FIG. 9 is a cross-sectional view of another example of a burst sub assembly which may be employed in a sidetracking system in accordance with embodiments of the present disclosure.
Figure 10:
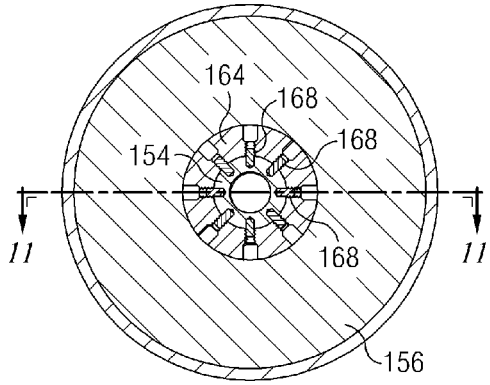
FIG. 10 is a cross-sectional view taken generally along line 10-10 of FIG. 9.
Figure 11:
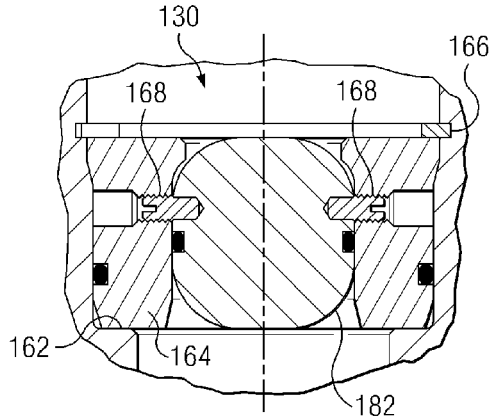
FIG. 11 is a cross-sectional view taken generally along line 11-11 of FIG. 10.

Referring generally to FIGS. 9-11, another alternate embodiment of burst sub 132 is illustrated. In this embodiment, many of the components are similar to components described with reference to FIGS. 6-8 and are labeled with the same reference numerals. The embodiment illustrated in FIGS. 9-11 provides an alternate burst sub 132 which utilizes flow restriction member 130 in the form of a barrel 182 which is secured within manifold 164 to block a flow path 184 through the manifold 164. In this similar embodiment, the burst sub 132 comprises sub housing 156 which includes internal flow path 158 as part of the central bore 102.

The internal flow path 158 is again defined by internal surface 160 having shoulder 162 to receive manifold 164 which is secured against shoulder 162 by retention ring 166. The barrel 182 is removably secured within manifold 164 by a plurality of shear members 168, as illustrated best in FIGS. 10 and 11. By way of example, the shear members 168 may comprise shear screws threaded into barrel 182.

In this latter embodiment, burst sub 132 also may comprise debris screen 170 positioned in internal flow path 158. The latter alternate embodiment of burst sub 132 also may have a variety of connection ends designed for engagement with other components of the sidetracking system 100. For example, box end 172 may be located at an upper end of the burst sub 132, and pin end 176 may be located at a lower end of the burst sub.

In operation, the flow passage 184 within mandrel 164 is blocked by barrel 182 during tripping of the sidetracking system 100 downhole. Once the system 100 is at the desired wellbore position, pressure may be immediately increased to set the expandable anchor and/or other components. Subsequently, the pressure may be further increased to shear off shear members 168 so that the barrel 182 is removed to provide a path for the cement slurry used to form cement plug 136.

Additional types of flow control subs 132 may be incorporated into the sidetracking system 100. Similarly, different numbers of expandable anchors and flow control subs may be employed depending on the requirements of a given application and on the number of tools to be actuated in preparing the well for a sidetracking operation. Various seal members, e.g. inflatable packers, may be employed to facilitate creation of cement plugs at many locations along the wellbore above the bottom of the wellbore. However, other sidetracking applications may benefit from creating a cement plug at the bottom of the wellbore. In some applications, the system enables cementing and drilling of the lateral wellbore at substantially the same time. By way of further example, the cement slurry may be delivered to fill a region surrounding at least a portion of the whipstock 118. The components and configurations of the sidetracking system 100 can be adjusted accordingly to accommodate these various sidetracking applications.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A sidetracking apparatus for setting a cement plug and for facilitating a sidetracking operation, comprising:

a whipstock assembly;

an expandable anchor assembly configured to be actuated and set in a wellbore wherein the expandable anchor assembly includes a pressure control sub for actuating the expandable anchor assembly; and a stinger assembly coupled to the whipstock assembly during running in hole, the stinger assembly having a stinger to convey cement through the sidetracking apparatus to a desired location of the wellbore;

wherein during a single trip in hole, the whipstock assembly is set and the stinger assembly is disconnected from the whipstock assembly prior to delivering cement to form a cement plug.

2. The sidetracking apparatus of claim 1, wherein the expandable anchor assembly is configured to be set at a specific wellbore depth.

3. The sidetracking apparatus of claim 1, wherein the pressure control sub includes a barrier blocking flow that enables actuating of the expandable anchor assembly.

4. The sidetracking apparatus of claim 3, wherein the barrier comprises a frangible member.

5. The sidetracking apparatus of claim 3, wherein the barrier comprises a rupture disc.

6. The sidetracking apparatus of claim 3, wherein the barrier comprises a ball on a ball seat.

7. The sidetracking apparatus of claim 1, wherein the whipstock assembly comprises a solid ramp configured to support drilling assemblies.

8. The sidetracking apparatus of claim 7, wherein the solid ramp is made from steel.

9. The sidetracking apparatus of claim 1, wherein the expandable anchor assembly comprises multiple slips configured to engage with a wall of the wellbore.

10. The sidetracking apparatus of claim 1, wherein the expandable anchor assembly is actuated hydraulically.

11. The sidetracking apparatus of claim 1, wherein the expandable anchor assembly comprises an expandable packing element.

12. The sidetracking apparatus of claim 1, wherein the pressure control sub includes a burst disc.

13. The sidetracking apparatus of claim 1, wherein the pressure control sub includes a ball activated mechanism.

14. The sidetracking apparatus of claim 1, further comprising a tail pipe.

15. A method for setting a cement plug and for providing a sidetracking operation thereafter, comprising:

running a sidetracking system having a whipstock assembly, an expandable anchor assembly, and a stinger assembly into a wellbore in a single trip;

orienting the whipstock assembly to a desired azimuth;

actuating the anchor assembly and setting a plurality of slips;

increasing bore pressure to open a fluid passage to a bottom of the sidetracking system;

releasing the stinger assembly from the whipstock assembly;

after releasing the stinger assembly, pumping cement through the stinger assembly; and retrieving the stinger assembly leaving the remaining components in the wellbore.

16. The method of claim 15, further comprising running a drilling assembly over the whipstock assembly for sidetracking.

17. The method of claim 15, wherein orienting the whipstock assembly comprises orienting with gyro equipment.

18. The method of claim 15, wherein increasing bore pressure to open the fluid passage comprises bursting a disc in a pressure control sub.

19. The method of claim 15, wherein increasing bore pressure to open the fluid passage comprises removing a ball and a ball seat positioned in a pressure control sub.

20. A sidetracking system, comprising:

a running assembly including a stinger;

a whipstock assembly separably coupled to the running assembly such that the stinger extends down into the whipstock assembly to deliver a cement slurry; and an expandable packer coupled to the whipstock assembly, wherein the expandable packer is settable within a wellbore to maintain the sidetracking system off a bottom of the wellbore and off a top of any stationary object in the wellbore and the running assembly is releasable from the whipstock assembly prior to delivering the cement slurry down through the whipstock assembly to form a cement plug beneath a sidetracking region.

21. The sidetracking system of claim 20, wherein the stinger is separably coupled to the running assembly by one or more shear members.

22. The sidetracking system of claim 20, wherein the whipstock assembly comprises a burst sub with a ball seat.

23. The sidetracking system of claim 20, wherein the whipstock assembly comprises a burst sub with a burst disc.

24. The sidetracking system of claim 20, wherein the whipstock assembly comprises a circulation sub located above the expandable packer.

25. The sidetracking system of claim 20, further comprising an anchor assembly separate from the expandable packer.

26. The sidetracking system of claim 20, wherein the cement plug is formed above the expandable packer.

27. A method to facilitate sidetracking, comprising:

running a whipstock assembly and an anchor assembly downhole on a stinger assembly in a single trip into a wellbore;

setting the anchor assembly;

releasing the stinger assembly from the whipstock assembly; and after releasing the stinger assembly, pumping cement through the stinger assembly to form a cement plug.

28. The method of claim 27, wherein setting the anchor assembly comprises pumping a fluid into a central bore of the whipstock assembly and increasing fluid pressure therein.

29. The method of claim 28, further comprising using a barrier member to enable increasing the fluid pressure in the central bore.

30. The method of claim 27, further comprising utilizing a whipstock of the whipstock assembly to enable sidetracking and creation of a lateral wellbore.

31. The method of claim 30, further comprising drilling a sidetracked wellbore.

32. The method of claim 27, wherein setting comprises pressurizing an internal bore of the whipstock assembly against a burst disc.

33. The method of claim 27, wherein setting comprises pressurizing an internal bore of the whipstock assembly against a ball dropped to a ball seat.

34. The method of claim 27, wherein setting comprises setting a plurality of slips.

35. The method of claim 27, wherein setting comprises setting an inflatable packer.

36. The method of claim 27, further comprising circulating fluid through the stinger assembly while running into the wellbore.

37. The method of claim 27, wherein releasing comprises shearing a shear member.

38. The method of claim 27, wherein pumping comprises pumping cement to a bottom of the wellbore.

39. The method of claim 27, wherein pumping comprises pumping cement to a location below the anchor assembly.

40. The method of claim 27, wherein pumping comprises pumping cement to a location above a seal member to create a plug above the bottom of the wellbore.

41. The method of claim 27, wherein pumping comprises pumping cement to fill around a whipstock of the whipstock assembly.

42. A method to facilitate sidetracking, comprising:

delivering a sidetracking system downhole into a wellbore;

gripping a wall of the wellbore with a component of the sidetracking system;

disconnecting a stinger assembly from a whipstock assembly of the sidetracking system; and after disconnecting, pumping cement through the stinger assembly to form a cement plug designed to facilitate a sidetracking operation.

43. The method of claim 42, wherein gripping comprises gripping the wall with a plurality of slips of an anchor assembly.

44. The method of claim 42, wherein disconnecting comprises shearing.

* * * * *